US008862000B2

(12) United States Patent
Murayama et al.

(10) Patent No.: US 8,862,000 B2
(45) Date of Patent: Oct. 14, 2014

(54) IMAGE FORMING APPARATUS AND CONTROL PROGRAM FOR DETECTING AND CORRECTING POSITIONAL OFFSET

(75) Inventors: Kentaro Murayama, Kasugai (JP); Yuji Goto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 397 days.

(21) Appl. No.: 13/334,291

(22) Filed: Dec. 22, 2011

(65) Prior Publication Data

US 2012/0163844 A1 Jun. 28, 2012

(30) Foreign Application Priority Data

Dec. 28, 2010 (JP) ..... 2010-292883

(51) Int. Cl.
*G03G 15/00* (2006.01)
*G03G 15/01* (2006.01)

(52) U.S. Cl.
CPC .... *G03G 15/0194* (2013.01); *G03G 2215/0161* (2013.01); *G03G 2215/0141* (2013.01); *G03G 15/5058* (2013.01)
USPC ..... 399/49; 399/301

(58) Field of Classification Search
CPC ..... G03G 15/5058; G03G 2215/0161
USPC ..... 399/49, 72, 301; 347/116
See application file for complete search history.

(56) References Cited

U.S. PATENT DOCUMENTS 5,442,388 A * 8/1995 Schieck ..... 347/116
2008/0225307 A1 9/2008 Murayama et al.
2008/0291477 A1 11/2008 Murayama
2008/0292370 A1 11/2008 Murayama
2010/0232819 A1 9/2010 Kudo et al.
2011/0026044 A1 2/2011 Murayama
2011/0026979 A1 2/2011 Murayama

FOREIGN PATENT DOCUMENTS

JP 2003162196 A 6/2003
JP 03-616295 B 2/2005
JP 2005043428 A 2/2005
JP 2005-309310 A 11/2005
JP 2006072074 A 3/2006
JP 2006-091384 A 4/2006

(Continued)

OTHER PUBLICATIONS

Notification of Reason for Refusal for related Japanese patent application No. 2010-292883 mailed Jan. 29, 2013.

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming apparatus includes: a conveyance member; a detection unit which outputs a detection signal according to a mark for image formation condition correction; an image forming unit which forms a print image and the mark; and a change unit which changes at least one of a printing reference position and a mark reference position such that an offset amount between the printing reference position and the mark reference position becomes larger as an angle difference between a sub-scanning direction and a conveyance direction of the conveyance member is larger, wherein the printing reference position is a basis of determining a formation position of the print image in a main scanning direction and the mark reference position is a basis of determining at least one of a formation position and a size of the mark in the main scanning direction.

11 Claims, 13 Drawing Sheets

(56) References Cited

FOREIGN PATENT DOCUMENTS

| | | | |
|---|---|---|---|
| JP | 2006276427 | A | 10/2006 |
| JP | 2008-225192 | A | 9/2008 |
| JP | 2008-292811 | A | 12/2008 |
| JP | 2008-292812 | A | 12/2008 |
| JP | 2010085422 | A | 4/2010 |
| JP | 2010217300 | A | 9/2010 |
| JP | 2011-033766 | A | 2/2011 |
| JP | 2011033765 | A | 2/2011 |

* cited by examiner

IMAGE FORMING APPARATUS AND CONTROL PROGRAM FOR DETECTING AND CORRECTING POSITIONAL OFFSET

CROSS-REFERENCE TO RELATED APPLICATION

This application claims priority from Japanese Patent Application No. 2010-292883, filed on Dec. 28, 2010, the entire subject matter of which is incorporated herein by reference.

TECHNICAL FIELD

Aspects of the present invention relate to an image forming apparatus which corrects an image forming condition when forming an image on an image forming medium.

BACKGROUND

There has been known an image forming apparatus in which a plurality of image forming units are arranged in parallel along a sheet conveyance belt and respective color images are sequentially formed on a sheet conveyed on the belt from the image forming units. This kind of image forming apparatus employs a technique referred to as registration so as to suppress deviations of image forming positions of the respective colors with respect to the sheet between the respective image forming units (for example, see JP 2008-225192A).

The image forming apparatus employing the technique includes an optical sensor having a light emission unit and a light reception unit, illuminates light on the belt by the light emission unit and receives the reflected light in the light reception unit, and the light reception unit outputs a light receiving signal corresponding to an amount of the received light. When executing the registration, the image forming apparatus forms marks on the belt by the respective image forming units and reads differences between reflectivity or amounts of reflected lights of a belt surface and mark surfaces based on the light receiving signal from the light reception unit, thereby determining positions of the marks and correcting image forming positions based on a result of the determination.

SUMMARY

In the image forming apparatus, an angle difference between a sub-scanning direction of the image forming unit and the conveyance direction of the belt may be caused. When the angle difference occurs, a problem that cannot be solved by the registration may be caused in forming an image. However, the related-art technique does not sufficiently address this problem of the angle difference.

Accordingly, an aspect of the present invention provides technique of suppressing an image formation problem which is caused due to an angle difference between a sub-scanning direction of the image forming unit and the conveyance direction of a conveyance member such as belt.

According to an illustrative embodiment of the present invention, there is provided an image forming apparatus comprising: a conveyance member configured to be rotated; a detection unit having a detection area on the conveyance member and configured to output a detection signal according to a mark for image formation condition correction, which passes the detection area; an image forming unit configured to form a print image on the conveyance member or on an image forming medium conveyed by the conveyance member when printing on the image forming medium, and configured to form the mark on the conveyance member or on an image forming medium conveyed by the conveyance member when detecting the mark by the detection unit; and a change unit configured to change at least one of a printing reference position and a mark reference position such that an offset amount between the printing reference position and the mark reference position becomes larger as an angle difference between a sub-scanning direction of the image forming unit and a conveyance direction of the conveyance member is larger, wherein the printing reference position is a basis of determining a formation position of the print image in a main scanning direction of the image forming unit and the mark reference position is a basis of determining at least one of a formation position and a size of the mark in the main scanning direction.

In the meantime, the inventive concept of the present invention can be embodied in various ways, such as a control apparatus, a control method, a printing apparatus, a printing method, a computer program for realizing the functions of the methods or apparatuses, a recording medium having recorded the computer program therein, and the like.

According to the above configuration, it is possible to suppress a problem occurring when forming an image, which is caused due to an angle difference between a sub-scanning direction of an image forming part and a conveyance direction of a conveyance member.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the present invention will be described with reference to the drawings.

(Overall Configuration of Printer)

Figure 1:
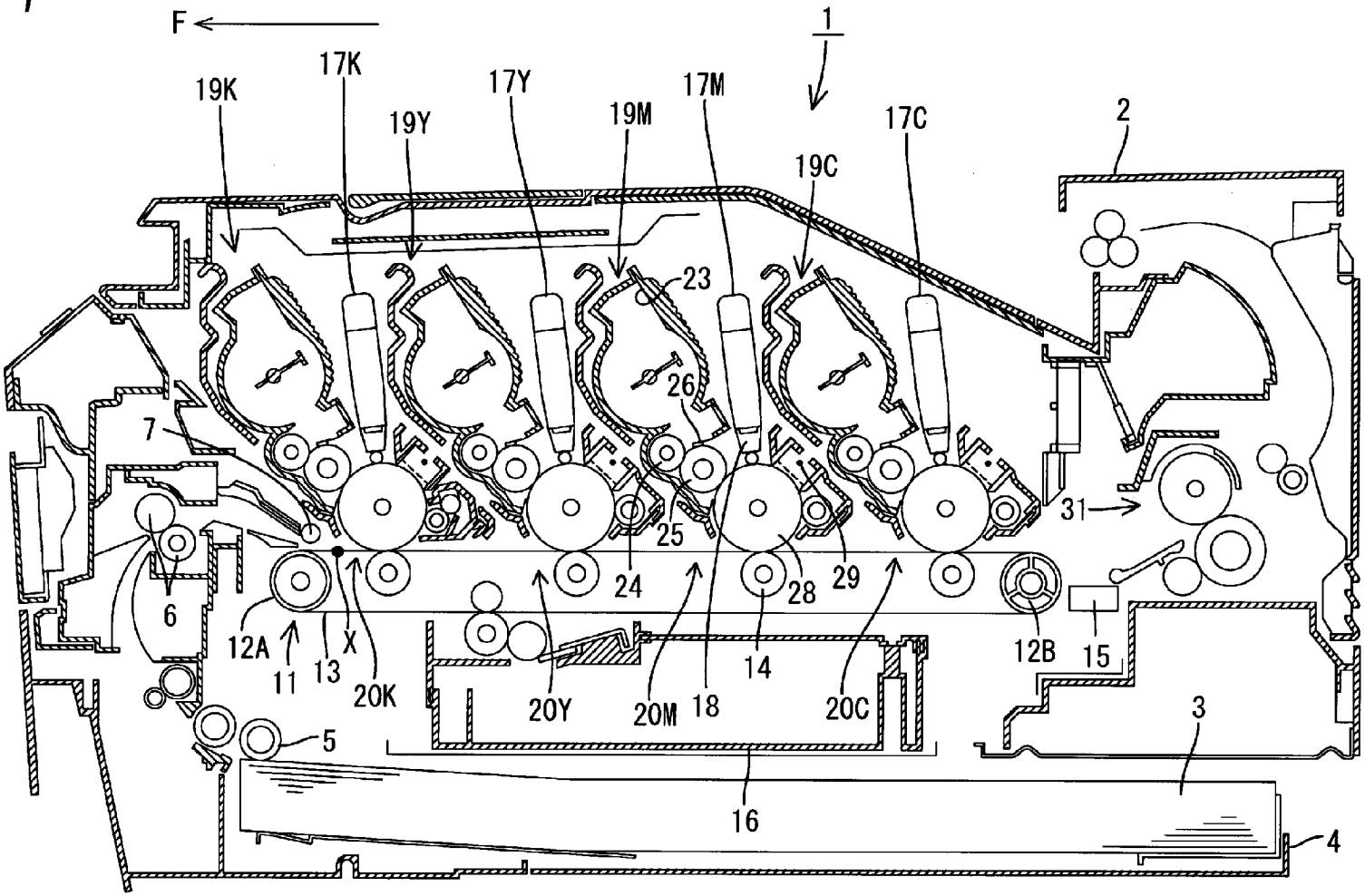
FIG. 1 is a side sectional view showing a schematic configuration of a printer according to an illustrative embodiment of the present invention.

FIG. 1 is a side sectional view showing a schematic configuration of a printer 1 (an example of the image forming apparatus) according to an illustrative embodiment of the present invention. The printer 1 is a color printer of a tandem type that is a multi-transfer type of forming a color image by using toners of four colors which are black K, yellow Y, magenta M and cyan C, for example.

A left side of FIG. 1 is a front side (which is indicated by an arrow F in several drawings) of the printer 1 and the front-back direction of the sheet of FIG. 1 is the left-right direction of the printer 1. In the below descriptions, in order to distinguish the respective constitutional parts or terms of the printer 1 with respect to colors, K (black), C (cyan), M (magenta) and Y (yellow) referring to the respective colors are attached to the constitutional parts and the like.

The printer 1 has a casing 2, and a tray 4 that can stack therein a plurality of sheets 3 (an example of the image forming medium such as sheet or OHP sheet) is provided at a bottom part in the casing 2. A pickup roller 5 is provided at the front-upper side of the tray 4. The pickup roller 5 is rotated to pick up the uppermost sheet 3 in the tray 4 to registration rollers 6. The registration rollers 6 correct inclination of the sheet 3 and then convey the sheet 3 onto a belt unit 11.

Also, a suction roller 7 is provided downstream from the registration rollers 6. The suction roller 7 is rotatably supported at the front-upper side of the belt unit 11 and contacts an upper surface of the sheet 3 conveyed from the registration rollers 6, thereby directing a leading end of the sheet 3 toward the belt unit 11 and pressing the same on a surface of a belt 13. In the meantime, a position of the belt 13 at which the leading end of the sheet 3 is pressed by the suction roller 7 is referred to as a press position X (an example of a reference point).

The belt unit 11 has a configuration where an endless belt 13 (an example of the conveyance member) extends between a pair of support rollers 12A, 12B. The belt 13 is made of resin material such as polycarbonate and a surface thereof is mirror-processed. The belt 13 is rotated in a clockwise direction as the rear support roller 12B is rotated, thereby conveying the sheet 3 put on the upper surface thereof in the rearward direction. Four transfer rollers 14 are provided at an inner side of the belt 13. The respective transfer rollers 14 are opposed to photosensitive members 28 of respective developing units 19K to 19C (which will be described later) with the belt 13 being interposed therebetween.

Also, mark sensors 15 (an example of a detection unit or a detection sensor) for detecting positions of marks M (refer to FIG. 3) formed on the surface of the belt 13 when executing a correction process (which will be described later) are provided at a rear end side of the belt 13. In addition, a cleaning apparatus 16 that collects toners (including correction patterns P that will be described later) or paper powders attached on the surface of the belt 13 is provided below the belt unit 11.

Four exposure units 17K, 17Y, 17M, 17C and four developing units 19K, 19Y, 19M, 19C are arranged in the front-rear direction above the belt unit 11. One set of an image forming unit 20 includes one of the exposure units 17K, 17Y, 17M, 17C, one of the developing units 19K, 19Y, 19M, 19C and one of the transfer rollers 14, respectively. That is, the printer 1 has four sets of image forming units 20K, 20Y, 20M, 20C corresponding to respective colors of black, yellow, magenta and cyan.

Each of the exposure units 17K to 17C has an LED head 18. The LED head 18 is provided with a plurality of LEDs (not shown), which are arranged in the left-light direction of the printer 1. The respective exposure units 17K to 17C are light emission-controlled based on image data to be formed and perform the exposure by illuminating lights onto surfaces of the opposed photosensitive members 28 on line-by-line basis.

In this illustrative embodiment, the arrangement direction (the front-back direction of the sheet of FIG. 1) of the LEDs of the respective exposure units 17 is a main scanning direction. The arrangement direction of the four developing units 19K, 19Y, 19M, 19C, i.e., four photosensitive members 28 is a sub-scanning direction that is orthogonal to the main scanning direction.

Each of the developing units 19K to 19C has a toner accommodation chamber 23 that accommodates therein toner of each color, which is colorant. The toner in the toner accommodation chamber 23 is supplied to a supply roller 24. The toner on the supply roller 24 is positively friction-charged between a developing roller 25 and the supply roller while being supplied to the developing roller 25. The toner on the developing roller 25 is further friction-charged between a layer thickness regulation blade 26 and the developing roller 25 and thus forms a thin layer having a predetermined thickness.

In addition, each of the developing units 19K to 19C has a photosensitive member 28 having a surface covered by the positively charged photosensitive layer and a scorotron-type charger 29. When detecting a mark and performing a printing operation, the photosensitive member 28 is rotated and the surface of the photosensitive member 28 is uniformly positively charged by the charger 29. Then, the positively charged parts are exposed by the exposure units 17K to 17C, so that electrostatic latent images are formed on the surfaces of the photosensitive members 28.

Then, the toners on the developing rollers 25 are supplied to the electrostatic latent images, so that the electrostatic latent images become visible images and toner images are thus formed. Thereafter, the toner images carried on the surfaces of the respective photosensitive members 28 are sequentially transferred on the sheet 3 by a negative transfer voltage that is applied to the transfer rollers 14 while the sheet 3 passes to respective transfer positions between the photosensitive members 28 and the transfer rollers 14. The sheet 3 having the toner images transferred thereon is then conveyed to a fixing unit 31 where the toner images are then heat-fixed. Then, the sheet 3 is conveyed in the upward direction and discharged to an upper surface of the casing 2.

(Electrical Configuration of Printer)

Figure 2:
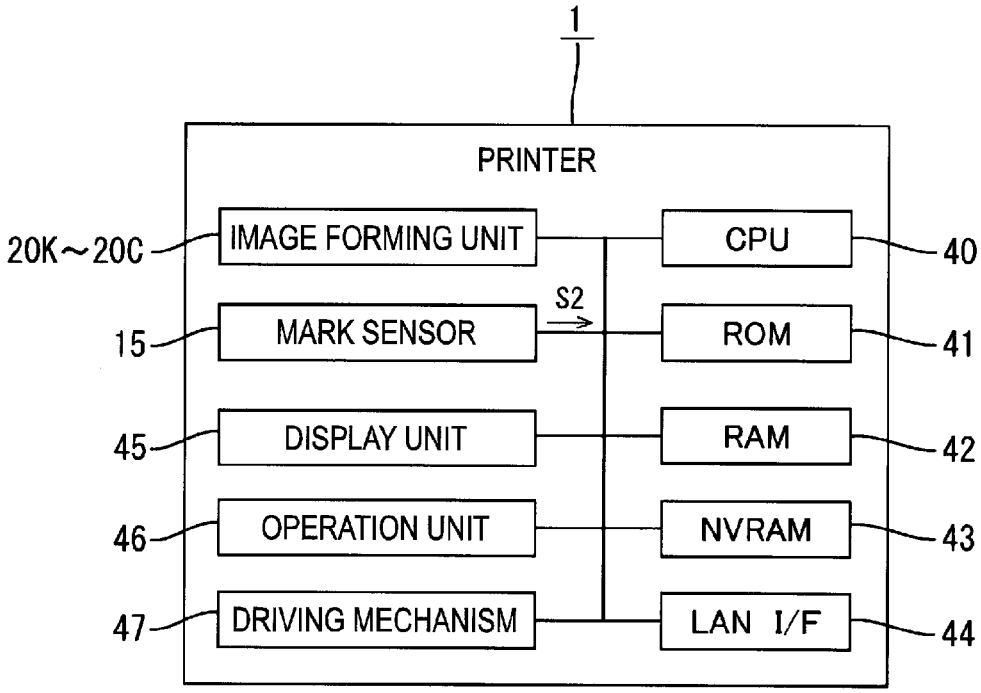
FIG. 2 is a schematic block diagram showing an electrical configuration of the printer.

FIG. 2 is a schematic block diagram showing an electrical configuration of the printer 1. As shown in FIG. 2, the printer 1 has a CPU 40 (an example of a specifying unit or a change unit), a ROM 41, a RAM 42, an NVRAM 43 which is a non-volatile memory and a network interface 44, to which the image forming units 20K to 20C, the mark sensors 15, a display unit 45, an operation unit 46 and a driving mechanism 47 are connected.

The ROM 41 stores programs for executing various operations of the printer 1. The CPU 40 stores a process result in the RAM 42 or NVRAM 43 and controls the respective components according to the programs read out from the ROM 41. The network interface 44 is connected to an external computer (not shown) through a communication line, so that data communication can be performed between the printer and the computer.

The display unit 45 has a liquid crystal display, a lamp and the like, and can display a variety of setting screens, operating states of the apparatus and the like. The operation unit 46 has a plurality of buttons and a user can perform a variety of input operations through the operation unit. The driving mechanism 47 has a driving motor and the like and rotates the belt 13 and the like.

(Configuration of Mark Sensor)

Figure 3:
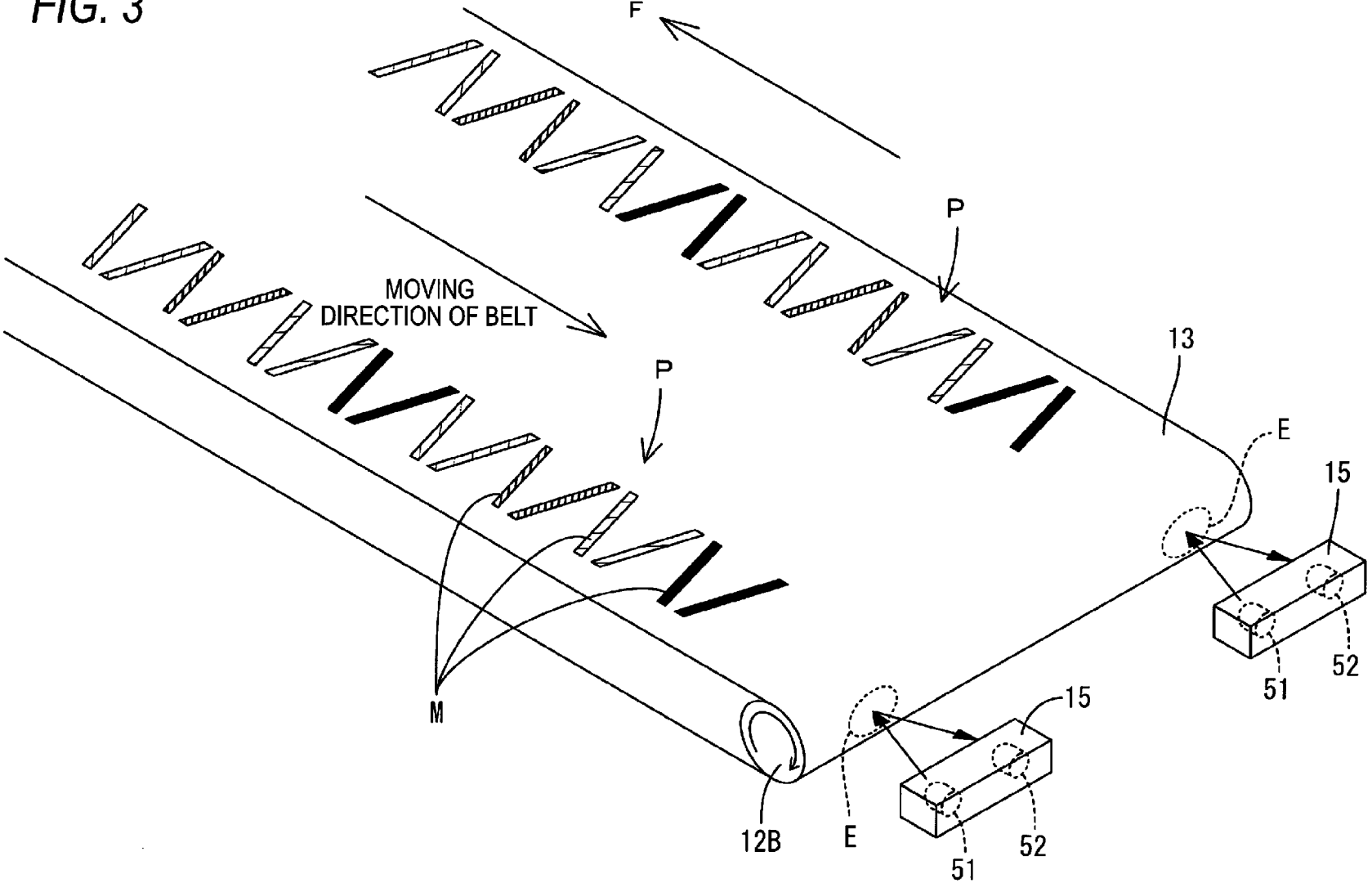
FIG. 3 is a perspective view showing mark sensors and a belt.

As shown in FIG. 3, one or more of the mark sensors 15 (two mark sensors in this illustrative embodiment) are provided at the rear-lower side of the belt 13 and the two marks sensors 15 are arranged in the left-right direction. Each mark sensor 15 is a reflection-type optical sensor having a light emitting device 51 (for example, an LED) and a light receiving device 52 (for example, a photo transistor). Specifically, the light emitting device 51 emits light onto the surface of the belt 13 in an oblique direction and the light receiving device 52 receives light reflected from the surface of the belt 13. An area that is defined on the belt 13 by the light emitted from the light emitting device 51 becomes a detection area E of the mark sensor 15.

Figure 4:
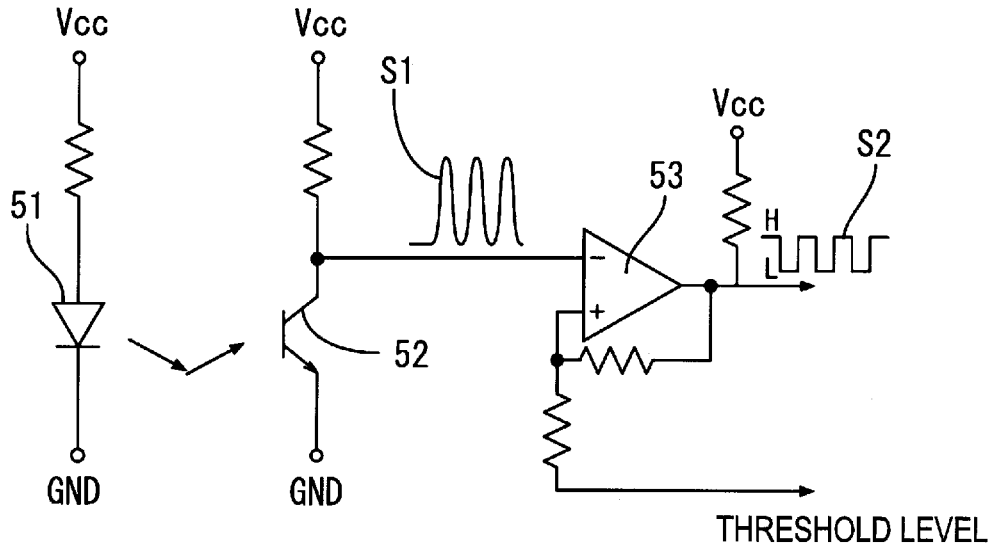
FIG. 4 shows a circuit configuration of a mark sensor.

FIG. 4 is a circuit diagram of the mark sensor 15. When a level of an amount of light received in the light receiving device 52 is high, a light receiving signal S1 from the light receiving device 52 becomes a lower level. When the level of the amount of the received light is low, the light receiving signal becomes a higher level. The light receiving signal S1 is input in a hysteresis comparator 53. The hysteresis comparator 53 compares the level of the light receiving signal S1 with a threshold (first threshold TH1, second threshold TH2) and outputs a binarized signal S2 (an example of a detection signal) whose level is reversed in accordance with a result of the comparison.

(Configuration of Correction Pattern)

Figure 5:
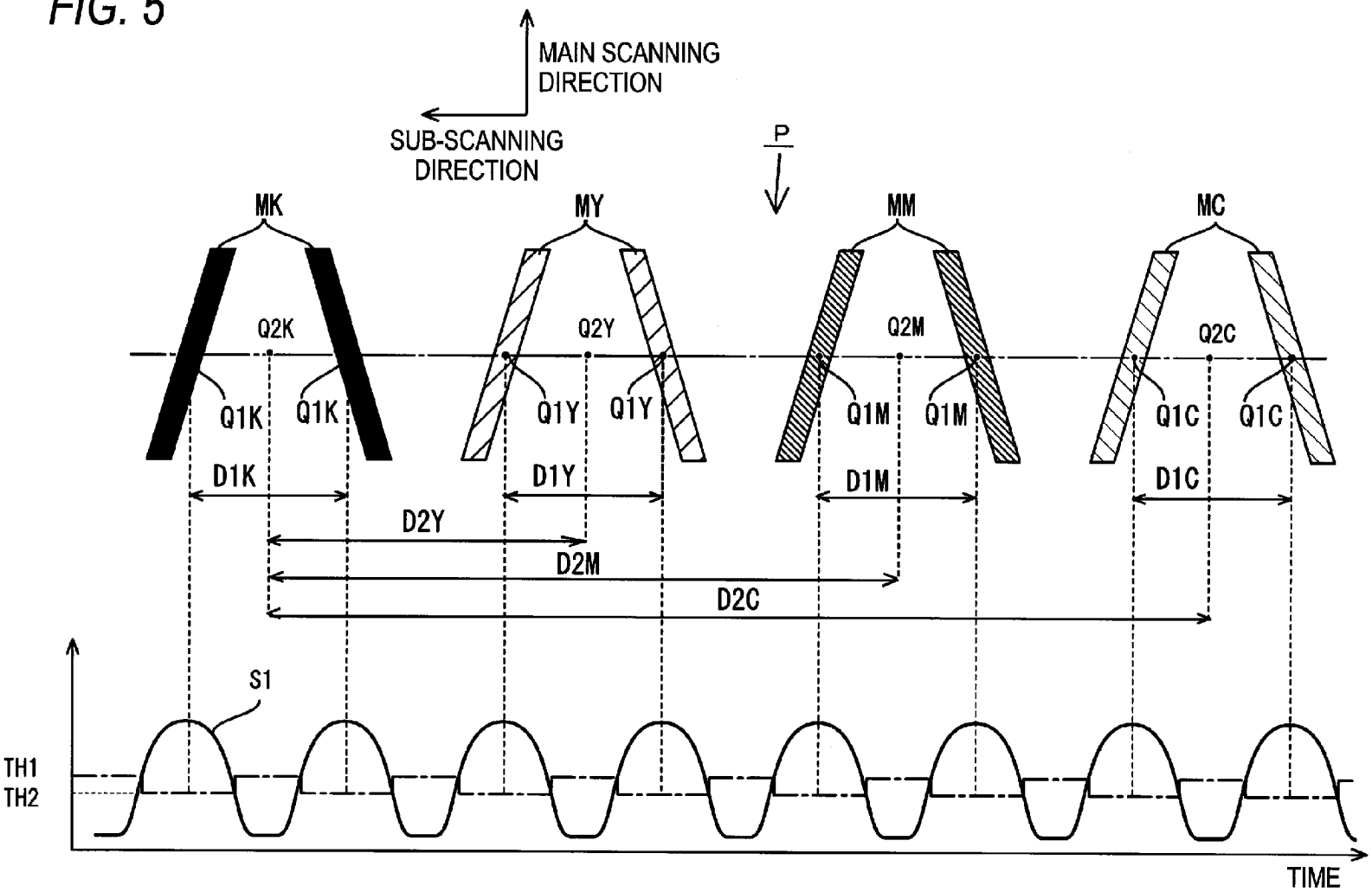
FIG. 5 shows a relation between a correction pattern and a waveform of a light receiving signal.

FIG. 5 shows a configuration of a correction pattern P at the upper side and a waveform of the light receiving signal S1 at the lower side when marks M of respective colors configuring the correction pattern P pass the detection area E. It is noted that the left-right direction of FIG. 5 is the sub-scanning direction.

The correction pattern P is used to specify degrees of positional deviation in the main and sub-scanning directions between color images formed by the respective image forming units 20 and an angle difference θ between the sub-scanning direction and the conveyance direction of the belt 13. As described below, a printing condition (exposure starting timing of the exposure unit 17 and the like) is corrected when performing a printing operation, based on the specified result.

The correction pattern P includes one or more of sets, each of which has a mark group including a black mark MK, a yellow mark MY, a magenta mark MM and a cyan mark MC are arranged in the substantial sub-scanning direction in this order (in FIG. 5, only one set is shown). Each mark M has a pair of rod-shaped marks. The rod-shaped marks are respectively inclined at a predetermined angle with respect to a line along the main scanning direction and are arranged in a linear symmetry with respect to the line.

In this illustrative embodiment, the belt 13 is mirror-processed as described above and has a reflectivity higher than any of the four toners. Accordingly, as shown at the lower side of FIG. 5, the level of the light receiving signal S1 is lowest when the light from the light emitting device 51 is emitted on a base (a surface of the belt 13 on which the mark M is not formed) of the belt 13. In contrast, when the light from the light emitting device 51 is emitted on the mark M formed on the belt 13, the level of the amount of light received in the light receiving device 52 is lowered and the level of the light receiving signal S1 is increased.

The CPU 40 calculates a middle position (a middle timing) between a rising edge and a falling edge of the binarized signal S2, for example, and sets the middle position as a position Q1 for each rod-shaped mark. Also, the CPU 40 sets a middle position between both rod-shaped marks Q1 and Q1 for each mark M as a position Q2 of the mark M in the sub-scanning direction.

In the below, regarding each mark M, a position deviation (Q1K-Q1K, Q1Y-Q1Y, Q1M-Q1M, Q1C-Q1C) between the rod-shaped marks is referred to as a mark width D1. The mark width D1 is changed depending on positions of each mark M in the main scanning direction. Also, a position deviation (Q2K-Q2Y, Q2K-Q2M, Q2K-Q2C) between the black mark MK and the other color marks MY, MM, MC in the sub-scanning direction is referred to as an inter-mark distance D2. The inter-mark distance D2 is changed depending on degrees of positional deviation of the other color images with respect to the black image in the sub-scanning direction.

(Deviation of Image End of Print Image Due to Angle Difference 0)

Figure 6:
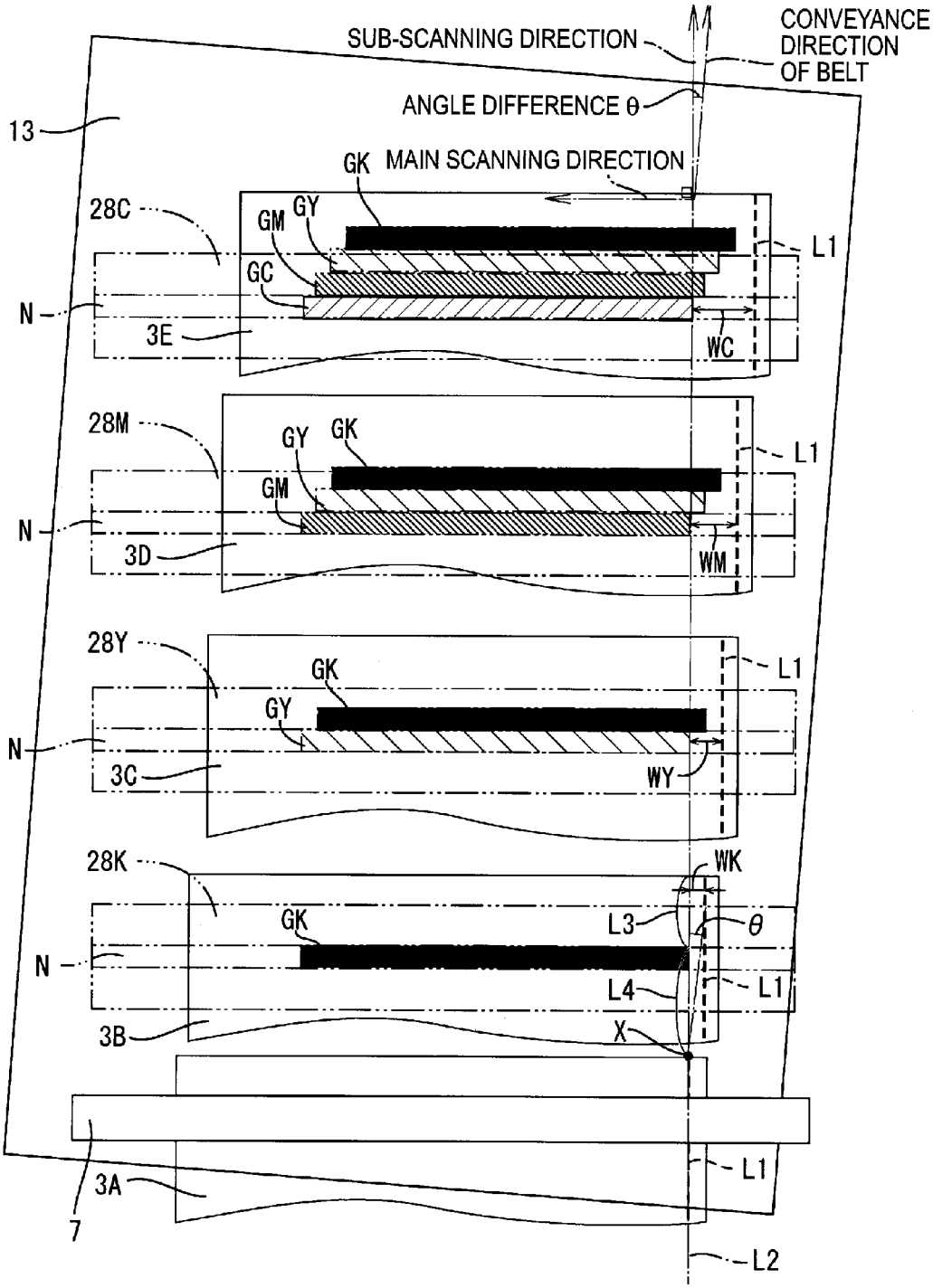
FIG. 6 schematically shows a sequence of forming line images in the state where an angle difference occurs.

FIG. 6 schematically shows a sequence of forming a line image G (an example of a print image) on the sheet 3 (3A to 3E) by the respective image forming units 20 in the state where an angle difference θ between the sub-scanning direction and the conveyance direction of the belt 13 occurs. A margin line L1 shown with a dotted line in FIG. 6 is a boundary line between a printing area and a margin area on the sheet 3. In the meantime, the margin area has preferably a width of 4.2 mm (100 dots) in the main scanning direction, for example. However, the width may be 0 mm. Also, the margin line L1 of the sheet 3A when the leading end of the sheet 3A reaches the press position X, i.e., touches the belt 13 is particularly referred to as a reference margin line L2.

Also, printable areas N that are positioned on the belt 13 just below the respective image forming units 20 (photosensitive members 28) indicate ranges where an image can be formed on the sheet 3 or belt 13 and have respectively a width in the main scanning direction, which is substantially equal to the entire length of all the LED rows of the exposure unit 17. FIG. 6 shows a case where each image forming unit 20 forms the line image G having a right end substantially matched to the reference margin line L2 in the printable area N. In this case, if the angle difference θ is substantially zero, the sheet 3 is conveyed to the printable areas N of the respective image forming units 20 with the margin line L1 being substantially matched to the reference margin line L2. Accordingly, it is possible to form a normal image, in which the right ends of the line images G of all colors are substantially matched to the margin line L1.

However, when there is caused an angle difference θ, an image end deviation occurs in which the right ends of the line images G of respective colors formed on the sheet 3 are deviated from the margin line L1 and are not uniform. Specifically, when there is caused an angle difference θ, the sheet 3 is conveyed in a direction (conveyance direction of the belt 13) inclined by the angle difference θ with respect to the sub-scanning direction while the leading end side of the sheet keeps a posture along the main scanning direction. Accordingly, when the leading end of the sheet 3B, for example, passes over the printable area N for black, the margin line L1 is rightwards deviated from the margin line L2. Hereinafter, a degree of deviation is referred to as a degree of margin deviation. Therefore, image end deviation is caused in the black line image GK in which the right end of the black line image is deviated leftwards from the margin line L1 by the degree of margin deviation WK.

When the leading end of the sheet 3C, for example, passes over the printable area N for yellow, the degree of margin deviation is further increased. As a result, the right end of the yellow line image GY on the sheet 3C is deviated leftwards from the margin line L1 by the degree of margin deviation WY larger than that of the black line image GK. Likewise, the right end of the magenta line image GM on the sheet 3D is deviated leftwards from the margin line L1 by the degree of margin deviation WM larger than that of the yellow line image GY, and the right end of the cyan line image GC on the sheet 3E is deviated leftwards from the margin line L1 by the degree of margin deviation larger than that of the magenta line image GM.

(Relation Among Angle Difference θ, Printing Reference Position and Mark Reference Position)

A printing reference position is a position in the main scanning direction, which becomes a basis of determining a formation position of a print image on the sheet 3 to be conveyed to the belt 13. Specifically, the printing reference position is a position in the main scanning direction, which becomes a basis of matching an end portion (right end in this illustrative embodiment) of the print image of each color so as to suppress the image end deviation when performing a printing operation. The printing reference position is preferably set with formation positions of the end portions of the print images formed by the image forming units 20K, 20Y positioned upstream in the conveyance direction, more preferably with the reference margin line L2. The reason is as follows. The closer the printing reference position to the upstream side of the conveyance direction, the shorter the distance to the press position X, so that the degree of margin deviation is smaller as shown in FIG. 6 and a fluctuation of the degree of margin deviation due to the change of the angle deviation θ is also smaller stochastically.

A mark reference position is a position in the main scanning direction, which becomes a basis of determining a formation position of the mark M of the correction pattern P on the belt 13. Specifically, the mark reference position is a position in the main scanning direction, which becomes a basis of causing a center (which is a position corresponding to the mark width D1) of the mark M of each color in the main scanning direction to pass the detection area E so as to suppress detection accuracy of the mark sensor 15 from being lowered when detecting a mark in a correction process (which will be described later). The mark reference position is preferably set with the formation positions of the marks M formed by the image forming units 20M, 20C positioned downstream from the conveyance direction. The reason is as follows. The closer the mark reference position to the downstream side of the conveyance direction, the shorter the distance to the detection area E, so that a degree of detection deviation, which is the degree of deviation between the formation position of the mark M and the detection area E in the main scanning direction, is smaller and a fluctuation of the degree of margin deviation due to the change of the angle deviation θ is also smaller stochastically.

Figure 7:
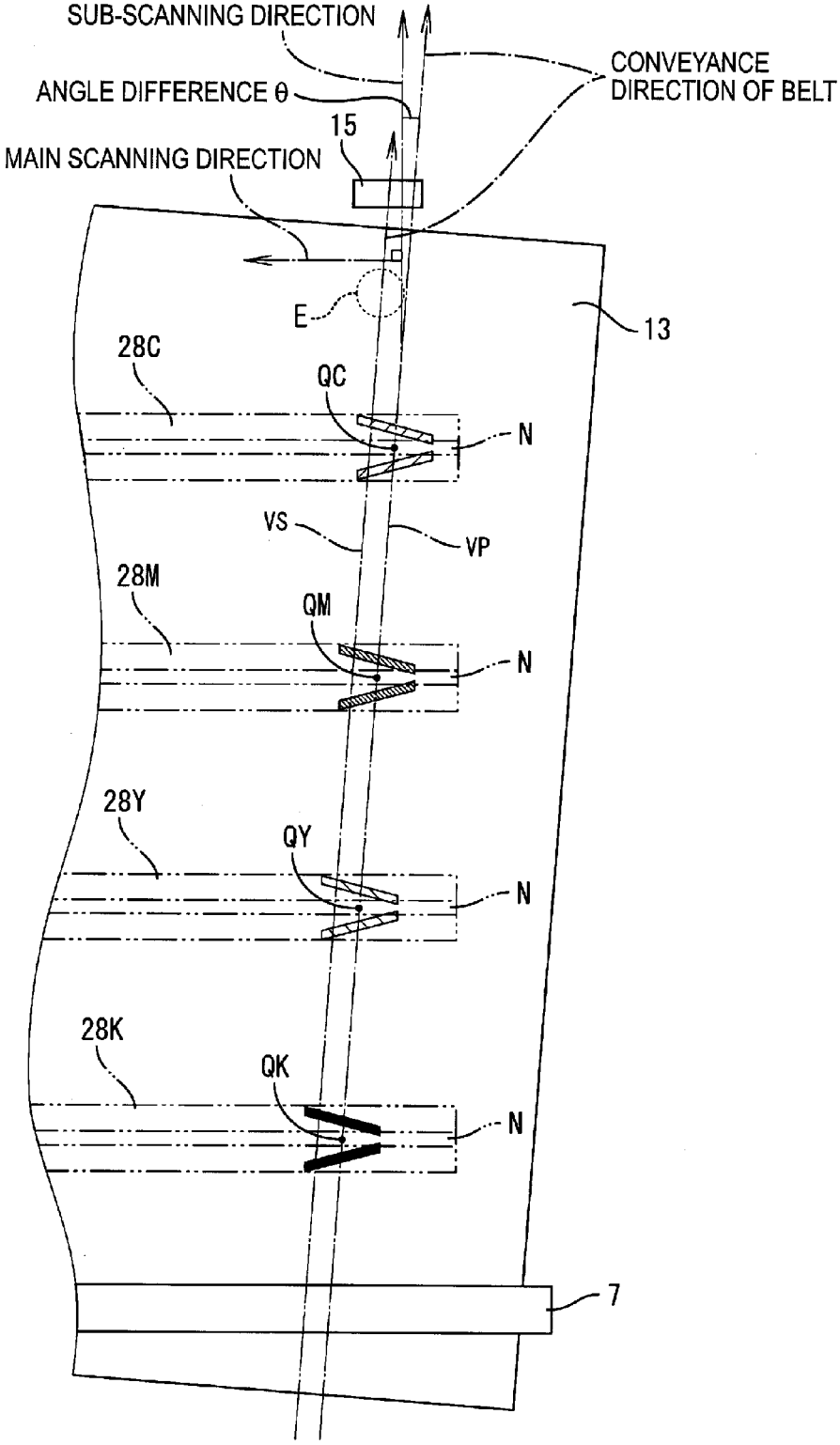
FIG. 7 shows a case where the correction pattern is formed based on a printing reference position in the state where an angle difference occurs.
Figure 8:
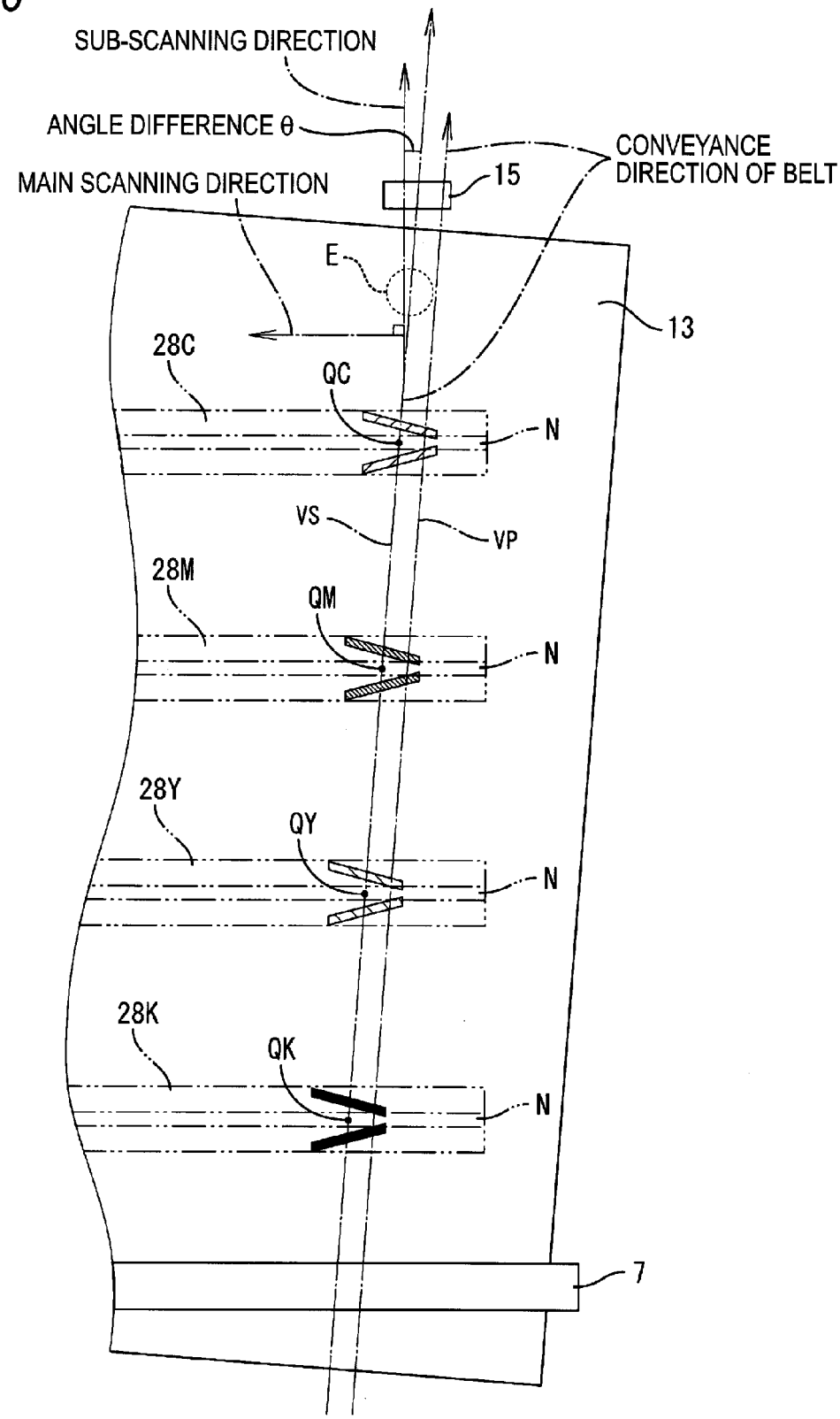
FIG. 8 shows a case where the correction pattern is formed based on a mark reference position in the state where an angle difference occurs.

FIG. 7 shows a case where the correction pattern P is formed on the belt 13 based on the printing reference position in the state where an angle difference θ occurs and FIG. 8 shows a case where the correction pattern P is formed on the belt 13 based on the mark reference position in the state where an angle difference θ occurs. In FIGS. 7 and 8, only the marks M that are formed in the printable areas N by the respective image forming units 20 are shown. Also, a dashed-dotted line arrow VP is a line connecting the center positions Q of the marks M that are formed based on the printing reference position, and is hereinafter referred to as the printing reference line VP. A dashed-dotted line arrow VS is a line connecting the center positions QK to QC of the marks M that are formed based on the mark reference position, and is hereinafter referred to as the mark reference line VS. In the meantime, both the printing reference line VP and the mark reference line VS are substantially parallel with the conveyance direction of the belt 13.

As shown in FIG. 7, when the correction pattern P is formed on the belt 13 based on the printing reference position, it is more difficult to cause the centers of the marks M to pass the detection area E, so that the detection accuracy of the marks M may be deteriorated. In the meantime, as shown in FIG. 8, when the correction pattern P is formed on the belt 13 based on the mark reference position, it is more easy to cause the centers of the marks M, which are formed in the respective printable areas N, to pass the detection area E and to thus suppress the detection accuracy of the marks M from being deteriorated. To the contrary, when the print image is formed on the belt 13 based on the mark reference position, the image end deviation may be caused.

As described above, the printing reference line VP and the mark reference line VS are not necessarily matched. In other words, the printing reference line and the mark reference line are not necessarily matched and an offset amount between the positions is preferably provided. As can be seen from FIGS. 7 and 8, the offset amount is preferably larger as the angle difference θ is larger. In this illustrative embodiment, the mark reference position is provided for the correction pattern P formed at the left side of the belt 13 and the correction pattern P formed at the right side of the belt 13, respectively.

(Correction Process)

Figure 9:
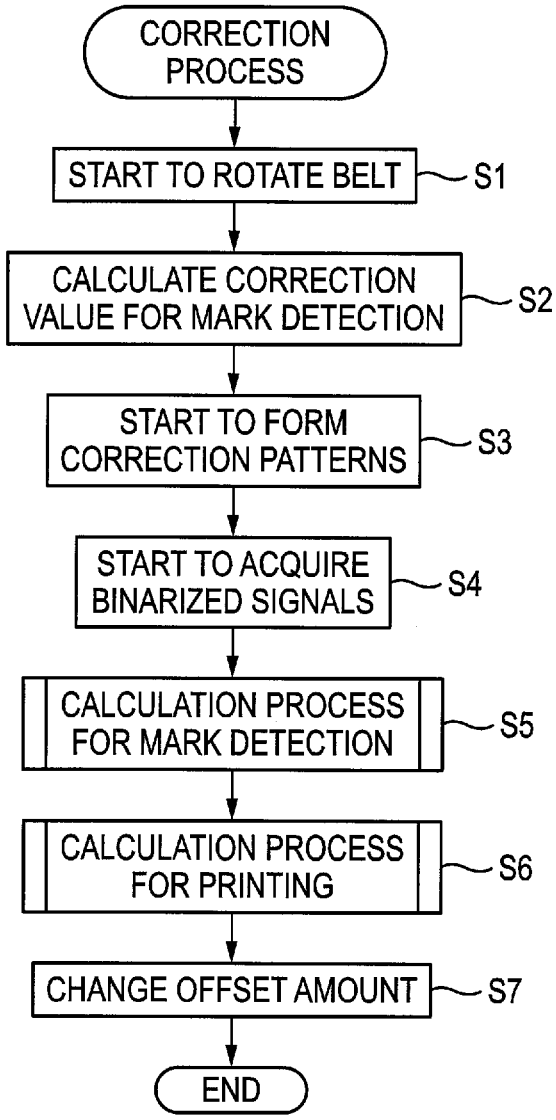
FIG. 9 is a flowchart showing a correction process.

FIG. 9 is a flowchart showing a correction process. When a predetermined condition is satisfied, for example when replacing the image forming unit 20 or the belt unit 11, when predetermined time elapses after a previous correction process is executed or when the sheet 3 having an image formed thereon reaches the predetermined number of sheets, the CPU 40 executes the correction process shown in FIG. 9. By executing the correction process, it is possible to correct the formation position of the print image and to change the offset amount, the printing reference position and the mark reference position.

First, the CPU 40 starts the driving mechanism 47 to rotate the belt 13 (S1). At this time, the CPU 40 does not covey the sheet 3. Then, the CPU 40 reads out a correction value of the sub-scanning direction, a correction value for printing (which will be described later) and an offset amount from the NVRAM 43 and thus calculates a correction value for right mark detection and a correction value for left mark detection with respect to the main scanning direction (S2). Here, initial values of the respective correction values are values (correction values are zero) when the angle difference θ is zero and a positional deviation (color deviation) between the respective colors is not caused in the main and sub-scanning directions, and are set in the manufacturing stage of the printer 1, for example. Also, an initial value of the offset amount is the substantially same as the distance between the printing reference position and the center position of the detection area E in the main scanning direction when the angle difference θ is zero.

Then, the CPU 40 controls the respective image forming units 20 to form the correction pattern P at the right side of the belt 13, based on the correction value of the sub-scanning direction and the correction value for right mark detection, and to form the correction pattern P at the left side of the belt 13, based on the correction value of the sub-scanning direction and the correction value for left mark detection (S3) and starts to acquire the binarized signals S2 from the mark sensors 15, respectively (S4). Then, the CPU 40 executes a calculation process for mark detection (S5) and a calculation process for printing (S6). In the meantime, both the processes may be executed in a reverse order to that shown in FIG. 9 and may be executed parallel with each other.

(1) Calculation Process for Mark Detection

Figure 10:
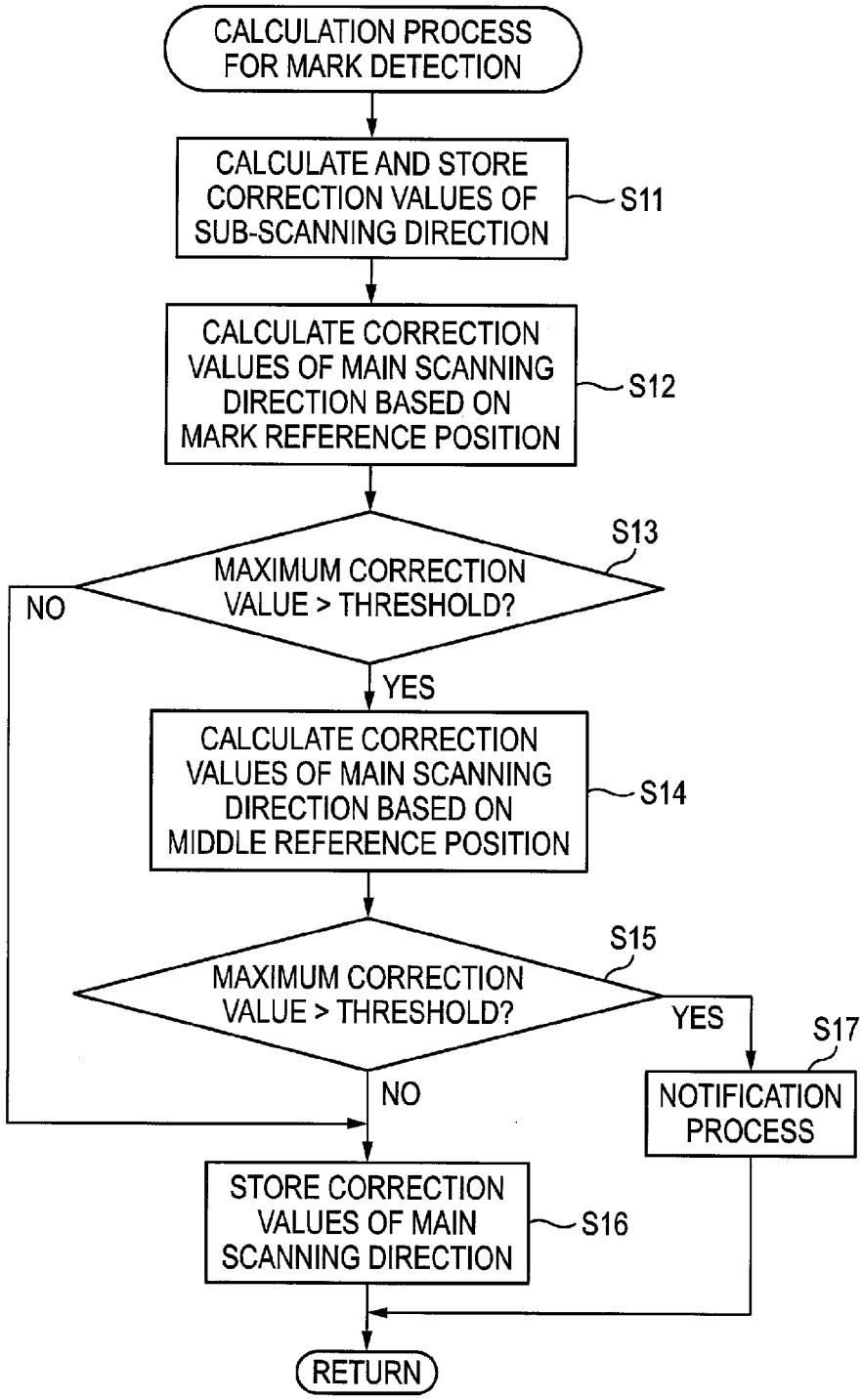
FIG. 10 is a flowchart showing a calculation process for mark detection.

FIG. 10 is a flowchart showing a calculation process for mark detection. As described below, the CPU 40 calculates the correction values of the sub-scanning direction of the respective colors, based on the binarized signals S2 corresponding to the left and right correction patterns P (S11).

Figure 11:
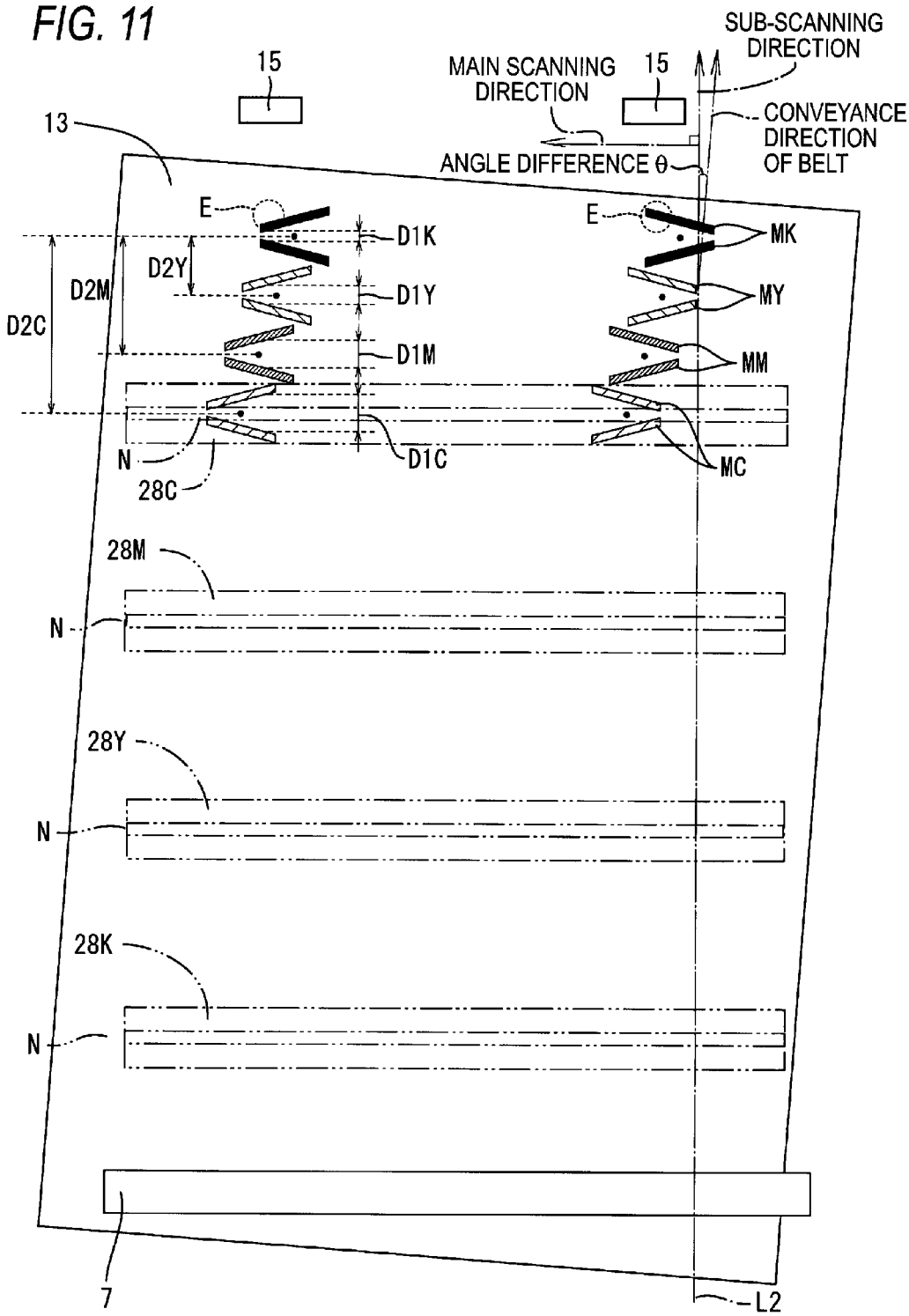
FIG. 11 is a schematic view showing that a cyan mark is formed in the state where an angle difference occurs.

FIG. 11 is a schematic view showing that the cyan mark M is formed in the state where an angle difference θ occurs. The image forming unit 20K forms the black mark MK in the printable area N for black and then the image forming unit 20Y forms the yellow mark MY when the black mark MK passes over the printable area N for yellow. At this time, the black mark MK is moved to a position that is deviated in the sub-scanning direction in correspondence to the angle difference θ with respect to the yellow mark MY.

Thereafter, the image forming unit 20M forms the magenta mark MM when the yellow mark MY passes over the printable area N for magenta. At this time, the black mark MK and the yellow mark MY are moved to positions that are deviated in the sub-scanning direction in correspondence to the angle difference θ with respect to the magenta mark MM. Also, as shown in FIG. 11, the image forming unit 20C forms the cyan mark MC when the magenta mark MM passes over the printable area N for cyan. At this time, the black mark MK, the yellow mark MY and magenta mark MM are moved to positions that are deviated in the sub-scanning direction in correspondence to the angle difference θ with respect to the cyan mark MC.

Then, the CPU 40 detects the mark widths D1K, MY, D1M, D1C of the respective marks M and the inter-mark distances D2Y, D2M, D2C, based on the binarized signals S2, and measures the degrees of positional deviation between the respective color marks in the sub-scanning direction, based on the detection results.

Specifically, the CPU 40 detects, for each mark group of the correction pattern P, the inter-mark distances D2Y, D2M, D2C, and calculates average values of the inter-mark distances D2 of all mark groups, for each of the yellow mark MY, the magenta mark MM and the cyan mark MC. Deviation between average values and prescribed values (inter-mark distances when the degrees of positional deviation of the other color images with respect to the black image in the sub-scanning direction are substantially zero) of the respective color marks are referred to as the degrees of positional deviations of the other color marks MY, MM, MC with respect to the black mark MK in the sub-scanning direction.

Then, in order to counterbalance the degrees of positional deviation in the sub-scanning direction, the CPU 40 calculates the correction values of the sub-scanning direction for changing light-emitting starting timings of the other color exposure units 17Y, 17M, 17C (for example, light-emitting starting timing of the LED heads 18 for exposing the leading lines of the other color images) and temporarily stores the same in the RAM 42, for example (S11).

Then, based on the binarized signal S2 from the right mark sensor 15, the CPU 40 calculates, for each color mark, the correction values for right mark detection of the main scanning direction based on the right mark reference position. Also, based on the binarized signal S2 from the left mark sensor 15, the CPU 40 calculates, for each color mark, the correction values for left mark detection of the main scanning direction based on the left mark reference position (S12). Here, the mark reference position is set with the position (refer to FIG. 8) of the main scanning direction, which causes the center (for example, center of the main scanning direction) of the cyan mark MC formed by the most downstream image forming unit 20C to pass the center of the detection area E.

The mark reference position can be set in advance by a positional relation between the image forming unit 20C for cyan and the right mark sensor 15. At this time, since the positional relation can be changed due to the external shock and the like, it is preferable to set the mark reference positions in order from differences between the detection value of the mark width D1C of the cyan mark MC and assumed values of the mark widths D1 when causing the center of the cyan mark MC to pass the center of the detection area E, as shown in FIG. 8.

Specifically, the CPU 40 calculates the average values of the mark widths D1 for the respective colors, based on the binarized signal S2 from the right mark sensor 15, and obtains the detection positions in the main scanning direction, based on the average values. Then, the CPU 40 sets the deviations between the detection positions of the respective color marks and the mark reference position as degrees of right positional deviation and obtains the correction values for right mark detection in the main scanning direction for changing the light-emitting starting timings of the exposure units 17K to 17C for respective colors (for example, LEDs for exposing one ends of the leading lines of the respective color images) so as to counterbalance the degrees of right positional deviation. The CPU 40 also obtains the correction values for left mark detection in the same manner.

The CPU 40 determines whether the maximum correction value of the correction values for right mark detection of the respective colors, which are based on the mark reference positions, exceeds a threshold (S13). The threshold is the upper limit of a correction amount in the main scanning direction, which is determined by the end position of the printable area N of each image forming unit 20 in the main scanning direction. When the maximum correction value is the threshold or smaller (S13: NO), it can be considered that even when the correction pattern P is formed based on the correction values for right mark detection, each mark M is not failed to be detected. Accordingly, the CPU 40 temporarily stores the correction values for right mark detection, which are based on the mark reference position, in the RAM 42, for example, as the correction values of the main scanning direction when detecting marks (S16) and proceeds to S6 in FIG. 9.

On the other hand, when the maximum correction value exceeds the threshold (S13: YES), a part or all of the mark M may be failed to be detected when the correction pattern P is formed based on the correction values for right mark detection. Therefore, the CPU 40 newly calculates the correction values for right mark detection of the main scanning direction, which are based on a middle reference position, without using the correction values for right mark detection based on the mark reference position (S14).

The middle reference position is preferably set with a value between two detection positions, which are obtained by extracting detection positions of marks of two colors whose detection positions are most distant from each other in the main scanning direction among the right marks M of the respective colors, and is more preferably set with a center position between both the detection positions. By using the middle reference position as the basis, it is possible to reduce the maximum correction value and to thus suppress the detection failure of the mark M, compared to the case where the mark reference position is used as the basis.

The CPU 40 sets the deviations between the detection positions of the respective color marks and the middle reference position as degrees of right positional deviation and obtains the correction values for right mark detection in the main scanning direction for counterbalancing the degrees of right positional deviation. The CPU 40 determines whether the maximum correction value of the correction values for right mark detection of the respective colors, which are based on the middle reference position, exceeds the threshold (S15). When the maximum correction value is the threshold or smaller (S15: NO), the CPU 40 temporarily stores the correction values for right mark detection, which are based on the middle reference position, in the RAM 42 as the correction values of the main scanning direction (S16) and proceeds to S6 in FIG. 9.

On the other hand, when the maximum correction value exceeds the threshold (S15: YES), a part or all of the mark M may be failed to be detected even when the correction pattern P is formed based on the middle reference position. Therefore, the CPU 40 executes a notification process of displaying an error indicating that the correction cannot be made on the display unit 45, for example (S17) and proceeds to S6 of FIG. 9 without storing any correction values for right mark detection based on the mark reference position and the middle reference position in the RAM 42.

Also for the correction values for left mark detection, when the maximum value of the correction values for left mark detection based on the mark reference position is the threshold or smaller (S13: NO), the CPU 40 temporarily stores the correction values for left mark detection in the RAM 42 as the correction values of the main scanning direction (S16). When the maximum value exceeds the threshold (S13: YES) and when the maximum value of the correction values for left mark detection based on the middle reference position is the threshold or smaller (S15: NO), the CPU 40 temporarily stores the correction values for left mark detection in the RAM 42 as the correction values of the main scanning direction (S16). When the maximum value exceeds the threshold (S15: YES), the CPU 40 does not store any correction value.

(2) Calculation Process for Printing

Figure 12:
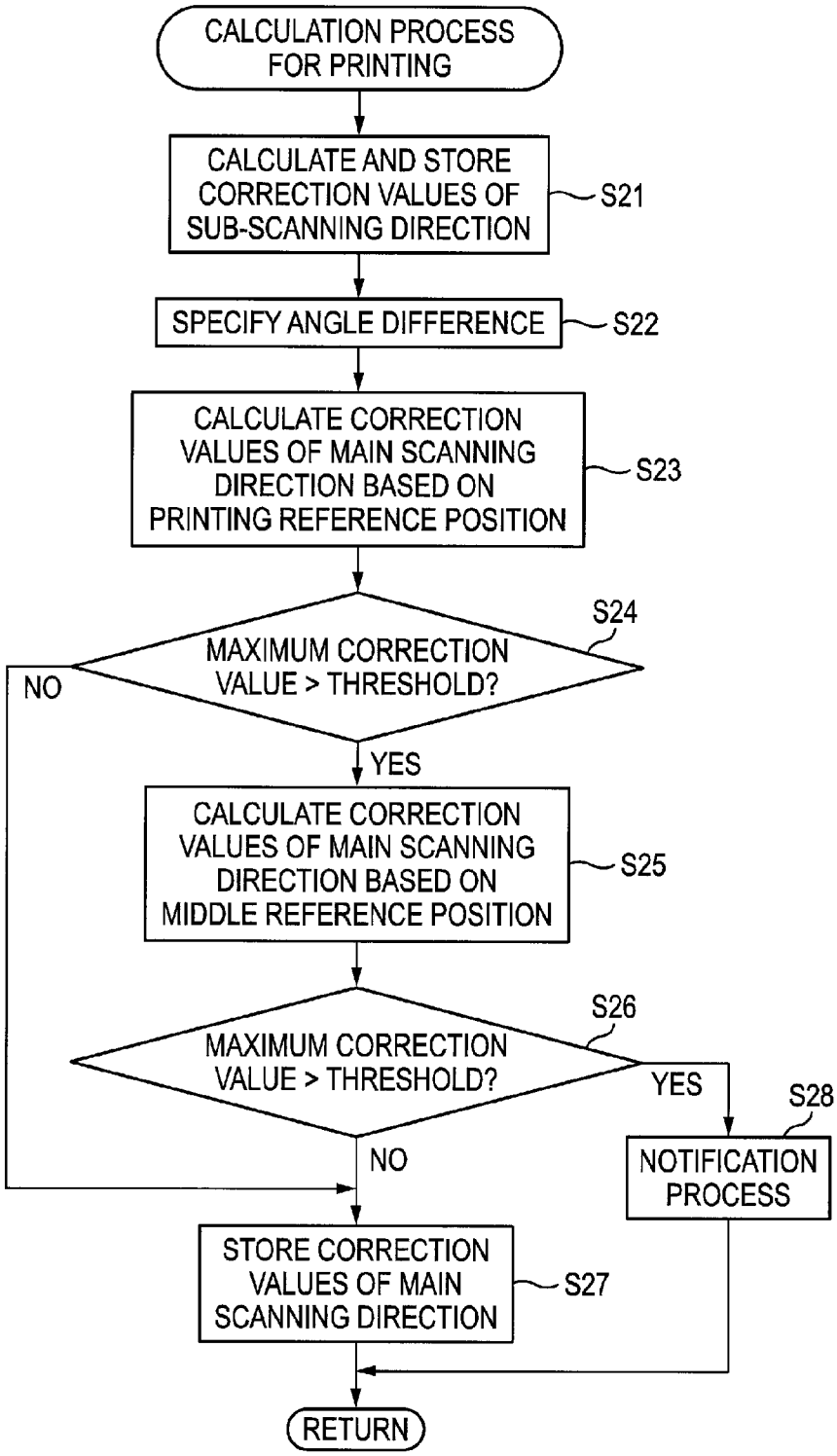
FIG. 12 is a flowchart showing a calculation process for printing.

FIG. 12 is a flowchart showing a calculation process for printing. The CPU 40 calculates the correction values of the sub-scanning direction of the respective colors, based on the binarized signals S2 corresponding to the left and right correction patterns P (S21), like S11 of FIG. 10.

Then, the CPU 40 specifies the angle difference θ, based on the positional relation of the marks M of the four colors (S22: an example of a specifying process). At this time, the CPU 40 functions as the specifying unit. Here, distances between the printable area N for black and the printable areas N of the other colors are set as inter-area distances D3Y, D3M, D3C. The inter-area distances D3Y, D3M, D3C are defined based on the structure of the printer 1. In this illustrative embodiment, the distances between the adjacent printable areas N are substantially equal.

Figure 13:
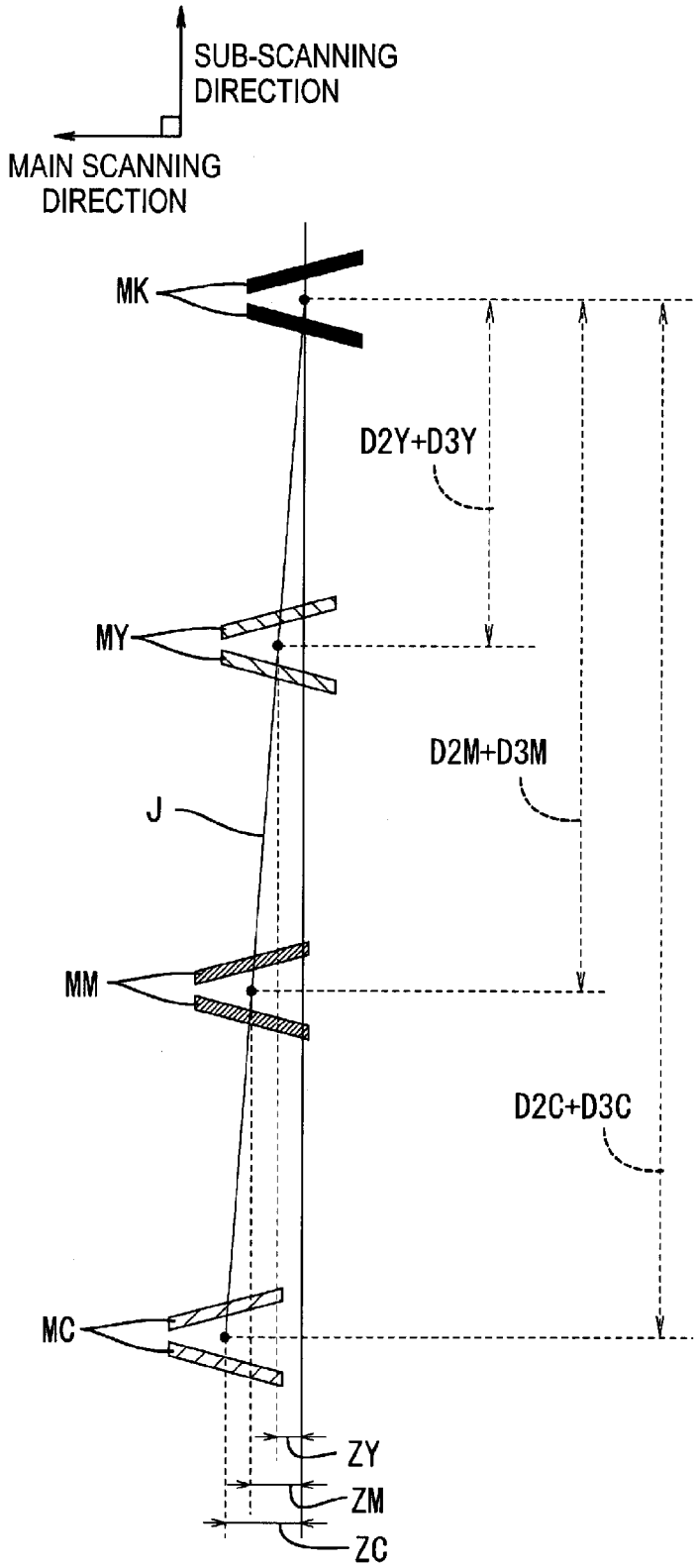
FIG. 13 is a schematic view showing a positional relation between marks M of respective colors.

FIG. 13 is a schematic view showing a positional relation that is converted from the positional relation between the marks M of respective colors shown in FIG. 11, taking the inter-area distances D3 into account. In FIG. 13, ZY, ZM and ZC indicate the degrees of positional deviation of the other color marks MY, MM, MC with respect to the black mark MK in the main scanning direction, respectively. As shown in FIG. 13, the yellow mark MY is formed when the belt 13 moves in the sub-scanning direction from the formation position of the black mark MK by a summed distance of the inter-mark distance D2Y and the inter-area distance D3Y, and is deviated in the main scanning direction from the black mark MK by the degree of positional deviation ZY.

The magenta mark MM is formed when the belt 13 moves in the sub-scanning direction from the formation position of the black mark MK by a summed distance of the inter-mark distance D2M and the inter-area distance D3M, and is deviated in the main scanning direction from the black mark MK by the degree of positional deviation ZM. The cyan mark MC is formed when the belt 13 moves in the sub-scanning direction from the formation position of the black mark MK by a summed distance of the inter-mark distance D2C and the inter-area distance D3C, and is deviated in the main scanning direction from the black mark MK by the degree of positional deviation ZC.

The respective color marks MK to MC shown in FIG. 13 are substantially arranged on a line along the conveyance direction of the belt 13. Accordingly, the angle difference θ may be specified by setting the line connecting the positions of the two marks of the respective color marks MK to MC in the conveyance direction of the belt 13. At this time, when the positional deviation is caused in the main scanning direction between the image forming units 20 of the respective colors, the specifying accuracy of the angle difference θ may vary due to the combination of the two marks M that are used so as to specify the angle difference θ.

Therefore, it is preferable to obtain an approximate line J by the least square method with respect to the positions of the three or more marks M of the marks MK to MC, to set a direction of the approximate line J as the conveyance direction and to thus specify the angle difference θ. In the meantime, it may be possible to specify the angle difference θ for only one of the left and right correction patterns P or to individually calculate the angle differences θ for each of the left and right correction patterns P and to finally specify an average of the angle differences as the angle difference θ.

When the angle difference θ is specified, the CPU 40 calculates, for the marks of respective colors, the correction values for printing of the main scanning direction by using the printing reference position as the basis, based on the binarized signals S2 from the left and right mark sensors 15 (S23). Here, the printing reference position is the position (refer to FIGS. 6 and 11) of the main scanning direction at which the right end of the print image formed by the most upstream image forming unit 20K for black is substantially matched to the margin line L1 of the sheet 3.

In the example of FIG. 6, the printing reference position is the position that is deviated leftwards from the formation position of the right end of the black line image GK by the degree of margin deviation WK. The degree of margin deviation WK can be calculated from a summed distance(=L3+L4) of the distance L3 from the press position X to the printable area N for black in the sub-scanning direction and the margin width L4 of the sheet 3 in the sub-scanning direction (the margin width L4 may be zero) and the angle difference θ. Also, the degrees of margin deviation WY to WC of the other colors can be calculated by adding the degree of margin deviation WK to the degrees of positional deviation of the line images GY to GC of the other colors with respect to the black line image GK in the main scanning direction.

Although the example of FIG. 6 is described, it is also possible to calculate the degrees of margin deviation for the marks M shown in FIG. 11 by the same manner. The CPU 40 calculates the average values of the mark widths D1 for the respective colors, based on the binarized signals S2 from the left and right mark sensors 15, obtains the detection positions of the main scanning direction, based on the average values, and calculates the degrees of positional deviation of the other color marks MY to MC with respect to the black mark MK in the main scanning direction from the detection positions of the respective colors.

Then, the CPU 40 obtains the correction values for printing of the main scanning direction for changing the light-emitting starting timings of the exposure units 17K to 17C for respective colors so as to counterbalance the degrees of positional deviation in the main scanning direction.

When the maximum value of the correction values for printing of the respective colors based on the printing reference position is the threshold or smaller (S24: NO), the CPU 40 temporarily stores the correction values for printing in the RAM 42 as the correction values of the main scanning direction at the printing time (S27) and proceeds to S7 of FIG. 9. When the maximum value exceeds the threshold (S24: YES), the CPU 40 newly calculates the correction values for printing of the main scanning direction, which are based on a middle reference position, without using the correction values for printing based on the printing reference position (S25).

When the maximum correction value of the correction values for printing based on the middle reference position is the threshold or smaller (S26: NO), the CPU 40 temporarily stores the correction values for printing in the RAM 42 as the correction values of the main scanning direction at the printing time (S27) and proceeds to S7 of FIG. 9. On the other hand, when the maximum correction value exceeds the threshold (S26: YES), the CPU 40 executes the notification process of displaying an error indicating that the correction cannot be made on the display unit 45, for example (S28) and proceeds to S7 of FIG. 9 without storing any correction values for printing based on the printing reference position and the middle reference position in the RAM 42.

In S7 of FIG. 9, the CPU 40 calculates an offset amount $\alpha R$ between the right mark reference position and the printing reference position and an offset amount $\alpha L$ between the left mark reference position and the printing reference position, respectively. The offset amounts a are changed into larger values as the angle difference $\theta$ is larger (an example of a change process). At this time, the CPU 40 functions as the change unit.

The difference between the correction value for printing for each color and the correction value for right mark detection is the same as the offset amount $\alpha R$ and the difference between the correction value for printing for each color and the correction value for left mark detection is the same as the offset amount $\alpha L$. Therefore, when one of the correction value for printing and the correction value for mark detection and the offset amounts $\alpha$ are stored in the NVRAM 43, for example, the other correction value can be calculated even when the other correction value is not stored. Therefore, in this illustrative embodiment, only the correction values for printing for respective colors and the offset amounts $\alpha L$, $\alpha R$ are stored in the NVRAM 43. Then, the CPU 40 ends the correction process.

In the meantime, in order for an operator to see an actual printing result and to thus adjust the margin, the printer 1 has a function of adjusting the correction value for printing, based on an input operation through the operation unit 46. However, since the operating amount is to adjust the correction value for printing, it is preferable that the operating amount is reflected in the correction value for printing and is not reflected in the correction value for mark detection.

(Effects of Illustrative Embodiments)

(1) When the angle difference $\theta$ occurs, at least one of the printing reference position and the mark reference position could become an inappropriate position. As a result, the printing accuracy or mark detection accuracy may be deteriorated to cause a problem in the image formation. Regarding this problem, as described above, it was found that the larger the angle difference $\theta$, the larger the offset amount $\alpha$ between the appropriate printing reference position and the appropriate mark detection position. Accordingly, in this illustrative embodiment, at least one of the printing reference position and the mark reference position is changed such that the offset amount $\alpha$ becomes larger as the angle difference $\theta$ is larger. Thereby, it is possible to suppress the problem in the image formation, which is caused due to the angle difference $\theta$.

(2) The angle difference $\theta$ is specified from the detection positions of the marks M, based on the binarized signals S2. Thereby, it is possible to specify the angle difference $\theta$ without providing a dedicated angle sensor and the like and to suppress the image fluctuation such as the image end deviation, which is caused due to the angle difference $\theta$.

(3) It is possible to specify the angle difference $\theta$ even from the detection position of the mark M that is formed by one image forming unit 20. However, when the positions of the image forming units 20 vary in the main scanning direction, it is preferable to specify the angle difference $\theta$ from the relation of the detection positions between the marks M that are respectively formed by at least two image forming units 20, as described in the illustrative embodiment. Thereby, it is possible to suppress the measurement accuracy of the angle difference $\theta$ from being deteriorated, which is caused due to the position variation of the image forming units 20.

(4) According to the above illustrative embodiment, the marks M are formed at the positions corresponding to the respective detection areas E of the at least two mark sensors 15 and the angle difference $\theta$ is specified from the detection positions of the marks. Thereby, it is possible to improve the specifying accuracy of the angle difference, compared to a configuration where the angle difference is specified from the detection position of the mark by one detection sensor.

(5) According to the above illustrative embodiment, the offset amounts $\alpha R$, $\alpha L$ between the printing reference position and the mark reference positions are changed in correspondence to the angle difference $\theta$, for each of the two mark sensors 15. Thereby, it is possible to make the mark reference positions appropriate positions for each of the detection sensors, compared to a configuration where only one mark reference position is provided for a plurality of detection sensors.

(6) According to the above illustrative embodiment, only one reference position of the printing reference position and the mark reference position are stored for each of the image forming units and one offset amount is commonly stored to the image forming units. Thereby, it is possible to reduce the storing burden of the storage unit, compared to a configuration where both reference positions of the printing reference position and the mark reference position are stored for each of the image forming units.

(7) According to the above illustrative embodiment, in forming the mark according to the mark reference position after the change corresponding to the offset amount, if at least a part of the mark is beyond the printable area, the mark reference position is corrected such that the formation position of the mark is moved toward the printable area (refer to S14 of FIGS. 10 and S25 of FIG. 12). Thereby, when detecting the mark, it is possible to suppress the detection incapability of the mark due to the detection failure of the mark or the deterioration of the detection accuracy.

(8) According to the above illustrative embodiment, in forming the mark according to the printing reference position after the change corresponding to the offset amount, if at least a part of the mark is beyond the printable area, the printing reference position is corrected such that the formation position of the print image is moved toward the printable area. Thereby, when performing the printing operation, it is possible to suppress the image quality from being deteriorated, which is caused due to the print failure of the print image.

(9) According to the above illustrative embodiment, the mark reference position is the position of causing the center of the mark to pass the detection area. Thereby, it is possible to suppress the erroneous detection of the mark, compared to a configuration where the mark reference position is a position of causing a part of the mark, rather than the center thereof, to pass the detection area.

<Other Illustrative Embodiments>

While the present invention has been shown and described with reference to certain illustrative embodiments thereof, it will be understood by those skilled in the art that various changes in form and details may be made therein without departing from the spirit and scope of the invention as defined by the appended claims.

(1) In the above illustrative embodiment, the printer of a tandem-type that is a multi-transfer type is described. However, the image forming apparatus of the present invention is not limited thereto. The inventive concept of the present invention is also applicable to a printer of a transfer member type of a multi-transfer type or a multi-developing type (multi-rotation type, single pass type). In this case, the photosensitive member is an example of the conveyance member of conveying the electrostatic latent image and the toner image and the developing member and the charger are an example of the image forming unit. Further, the inventive concept is also applicable to a printer of a multi transfer/intermediate transfer type (intermediate transfer member type/tandem type). In this case, the intermediate transfer member or photosensitive member is an example of the conveyance member of conveying the electrostatic latent image and the toner image and the developing member and the charger are an example of the image forming unit.

Still further, the inventive concept is applicable to a printer of another electro-photographic type such as polygon scanner type and a printer of an inkjet type. In this case, a conveyance direction of an ink head is the main scanning direction, and for a line type, a line direction is the main scanning direction. In addition, a single color (black/white) printer is also possible, instead of the color printer. In this case, a deviation in the main scanning direction between a predetermined formation position (for example, position of a specific LED) of a image forming unit and a detection position of a mark by a detection sensor is obtained and an angle difference can be specified from the deviation and a distance from the formation position to the detection area of the detection sensor in the sub-scanning direction.

(2) In the above illustrative embodiment, the sheet 3 is pressed on the belt 13 by the suction roller 7. However, the suction roller 7 may contact the belt 13. Also, a plate member, rather than the roller member such as suction roller 7, may be used. In other words, any pressing member may be used inasmuch as it presses the sheet 3 on the belt 13.

(3) In the above illustrative embodiment, the mark sensor 15 is described as the member of detecting the mark M. However, the detection unit and the detection sensor of the present invention are not limited thereto. For example, a CCD camera may be used. In this case, the mark M is detected from an imaging result of the CCD camera.

(4) In the above illustrative embodiment, the mark M consisting of the pair of rod-shaped marks arranged in a linear symmetry is described. However, the present invention is not limited thereto. For example, the pair of rod-shaped marks may be arranged in a linear asymmetry. Also, one rod-shaped mark may be provided and a width (thickness) of the rod-shaped mark in the sub-scanning direction may be different at respective positions in the main scanning direction (for example, a mark that is thicker toward the main scanning direction). In other words, any mark may be used inasmuch as it has a pair of edge parts whose distances between the edge parts are changed toward the main scanning direction, and a mark (concentration patch) for density correction may be also usable inasmuch as it is such mark.

Also, when the mark can detect the degrees of positional deviation between the respective color marks in the main scanning direction, it is possible to measure a deviation angle. Accordingly, a deviation pattern (for example, refer to JP 2008-292811A, JP2008-292812A) having marks pairs of a plurality of sets in which overlapping degrees of reference color marks and adjustment color marks are different may be also possible.

(5) In the above illustrative embodiment, the printing reference position is the position for suppressing the image end deviation. However, the present invention is not limited thereto. For example, a position for suppressing deviation (center deviation) of a center position between the sheet 3 and the print image in the main scanning direction may be also possible.

(6) In the above illustrative embodiment, the mark reference position is the basis of determining the position of the mark M in the main scanning direction. However, the present invention is not limited thereto. For example, in a configuration where a size of the mark M in the main scanning direction is increased/decreased so as to bring the mark M into the detection area E, a basis of determining the size in the main scanning direction may be also possible.

(7) In the above illustrative embodiment, the mark reference position is respectively provided for each of the left and right correction patterns P. However, the present invention is not limited thereto. For example, an average position of the right mark reference position and the left mark reference position may be provided as a common mark reference position. However, according to the above illustrative embodiment, it is possible to cause the marks M of the left and right correction patterns P to respectively pass the detection areas E of the left and right mark sensors 15 with high precision.

(8) In the above illustrative embodiment, the angle difference θ is specified based on the positional relation of the marks M. However, the specifying unit of the present invention is not limited thereto. For example, an angle sensor may be provided adjacent to the belt 13 and the angle difference θ may be specified by the angle sensor. Also, an imaging device of imaging a part of the belt 13, such as CCD, may be provided and the angle difference may be specified from a result of the imaging. In addition, a configuration where the specifying unit is not provided and a user inputs the angle difference θ through an input operation on the operation unit 46 may be also possible.

(9) In the above illustrative embodiment, the printing reference position and the mark detection position are individually detected and a difference thereof is calculated in the correction process, so that the offset amount is changed in correspondence to the angle difference θ. However, the change unit of the present invention is not limited thereto. For example, it may be also possible to beforehand store correspondence information (table or calculation equation) of the offset amount and the angle difference θ in the NVRAM 43, to determine only one of the printing reference position and the mark detection position and to change the offset amount corresponding to the specified angle difference θ.

(10) In the above illustrative embodiment, regarding the image fluctuation, the configuration of correcting the center deviation and the positional deviation has been described. However, the present invention is not limited thereto. The each color image may be deformed due to the angle difference θ. For example, even when it is intended to form a square-shaped image by the respective image forming units 20, the image formed on the sheet 3 may be deformed into a rhombic shape. Accordingly, in the above illustrative embodiment, a process of correcting leading positions (exposure starting positions) for each line may be performed for the respective color images so as to counterbalance the image deformation due to the angle difference θ.

(11) In the above illustrative embodiment, the conveyance direction of the belt 13 is obtained from the approximate line by the least square method. However, the present invention is not limited thereto. For example, a line direction passing to the positions of the marks M of two colors of the marks M of four colors may be set as the conveyance direction of the belt 13. In this case, the marks M of two colors are more preferably formed by the image forming units 20K, 20C that are respectively positioned at the most upstream and downstream in the conveyance direction of the belt 13.

(12) In the above illustrative embodiment, one CPU 40 executes the correction process. However, the present invention is not limited thereto. For example, a plurality of CPUs or dedicated circuit ASIC (Application Specific Integrated Circuit) may execute the correction process. For instance, the calculation process for mark detection and the calculation process for printing may be executed by different CPUs. In addition, the process of specifying the angle difference and the process of changing the offset amount may be executed by separate CPUs.

What is claimed is:

1. An image forming apparatus comprising:

a conveyance member configured to be rotated;

a detection unit having a detection area on the conveyance member and configured to output a detection signal according to a mark for image formation condition correction, which passes the detection area;

an image forming unit configured to form a print image on the conveyance member or on an image forming medium conveyed by the conveyance member when printing on the image forming medium, and configured to form the mark on the conveyance member or on an image forming medium conveyed by the conveyance member when detecting the mark by the detection unit; and a control device configured to change at least one of a printing reference position and a mark reference position such that an offset amount between the printing reference position and the mark reference position becomes larger as an angle difference between a sub-scanning direction of the image forming unit and a conveyance direction of the conveyance member is larger, wherein the printing reference position is a basis of determining a formation position of the print image in a main scanning direction of the image forming unit and the mark reference position is a basis of determining at least one of a formation position and a size of the mark in the main scanning direction.

2. The image forming apparatus according to claim 1, wherein the control device is configured to:

specify the angle difference, and change at least one of the printing reference position and the mark reference position such that the offset amount becomes larger as the specified angle difference is larger.

3. The image forming apparatus according to claim 2, wherein the control device is configured to specify the angle difference from a detection position of the mark, based on the detection signal.

4. The image forming apparatus according to claim 3, wherein the image forming unit includes a plurality of image forming units that are arranged in the sub-scanning direction and are configured to individually form the print image and the mark, and wherein the control device is configured to specify, based on the detection signal, the angle difference from a detection position relation between the marks that are respectively formed by at least two of the image forming units.

5. The image forming apparatus according to claim 3, wherein the detection unit includes at least two detection sensors, each of which has a detection area at different positions in the main scanning direction, wherein the image forming unit is configured to form marks at positions corresponding to the detection areas of the at least two detection sensors in the main scanning direction, and wherein the control device is configured to specify, based on detection signals from the at least two detection sensors, the angle difference from the detection positions of the marks in the main scanning direction.

6. The image forming apparatus according to claim 1, wherein the detection unit includes a plurality of detection sensors, each of which has a detection area at different positions in the main scanning direction, wherein a plurality of mark reference positions are provided in correspondence to the respective detection sensors, and wherein the control device is configured to change, for each of the mark reference positions, at least one of the printing reference position and the mark reference position such that the offset amount between the printing reference position and the mark reference position becomes larger as the angle difference is larger.

7. The image forming apparatus according to claim 1, wherein the image forming unit includes at least two image forming units that are arranged in the sub-scanning direction and are configured to individually form the print image, and the image forming apparatus further comprising:

a storage unit configured to store therein, for each of the at least two image forming units, only one of the printing reference position and the mark reference position, and store therein one offset amount common for both of the at least two image forming units.

8. The image forming apparatus according to claim 1, wherein in forming the mark according to the mark reference position after the change, if at least a part of the mark is beyond a printable area of the image forming unit, the control device is configured to correct the mark reference position such that the formation position of the mark is moved toward the printable area.

9. The image forming apparatus according to claim 1, wherein in forming the print image according to the printing reference position after the change, if at least a part of the print image is beyond a printable area of the image forming unit, the control device is configured to correct the printing reference position such that the formation position of the print image is moved toward the printable area.

10. The image forming apparatus according to claim 1, wherein the mark reference position is a position of causing a center of the mark to pass the detection area.

11. A non-transitory computer readable medium having a computer program stored thereon and readable by a computer provided in an image forming apparatus including: a conveyance member configured to be rotated; a detection unit having a detection area on the conveyance member and configured to output a detection signal according to a mark for image formation condition correction which passes the detection area; and an image forming unit configured to form a print image on the conveyance member or on an image forming medium conveyed by the conveyance member when printing on the image forming medium, and configured to form the mark on the conveyance member or on an image forming medium conveyed by the conveyance member when detecting the mark by the detection unit, the computer program, when executed by the computer, causing the computer to perform operations comprising:

changing at least one of a printing reference position and a mark reference position such that an offset amount between the printing reference position and the mark reference position becomes larger as an angle difference between a sub-scanning direction of the image forming unit and a conveyance direction of the conveyance member is larger, wherein the printing reference position is a basis of determining a formation position of the print image in a main scanning direction of the image forming unit and the mark reference position is a basis of determining at least one of a formation position and a size of the mark in the main scanning direction.

* * * * *